US007913409B2

(12) United States Patent
Wilson

(10) Patent No.: US 7,913,409 B2
(45) Date of Patent: Mar. 29, 2011

(54) CHALK LINE MARKING SYSTEM

(76) Inventor: Timothy J. Wilson, Springfield, VA (US)

( * ) Notice: Subject to any disclaimer, the term of this patent is extended or adjusted under 35 U.S.C. 154(b) by 300 days.

(21) Appl. No.: 12/324,242

(22) Filed: Nov. 26, 2008

(65) Prior Publication Data

US 2009/0133275 A1 May 28, 2009

Related U.S. Application Data

(60) Provisional application No. 60/990,534, filed on Nov. 27, 2007.

(51) Int. Cl.
*B44D 3/38* (2006.01)

(52) U.S. Cl. ..... 33/414; 33/758; 33/1 LE

(58) Field of Classification Search ..... 33/409, 33/410, 413, 414, 756, 758–760, 768, 770, 33/1 LE; D10/65, 71, 74; 24/326, 330, 331, 24/371, 376, 265 H, 265 EC, 265 R; 294/106, 294/110.1, 110.2, 116, 100, 115
See application file for complete search history.

(56) References Cited

U.S. PATENT DOCUMENTS

| | | | | |
|---|---|---|---|---|
| 2,513,256 | A * | 6/1950 | Sonnenburg | 294/82.24 |
| 2,549,287 | A * | 4/1951 | Brennan | 33/758 |
| 5,937,532 | A * | 8/1999 | Eirich et al. | 33/758 |
| 6,705,018 | B2 * | 3/2004 | Guhse | 33/414 |
| 7,200,949 | B2 * | 4/2007 | Leslie et al. | 33/414 |
| 7,594,336 | B2 * | 9/2009 | Spaulding | 33/413 |
| 7,676,941 | B2 * | 3/2010 | Cruz et al. | 33/414 |
| 2002/0026723 | A1 * | 3/2002 | Savalla | 33/414 |

* cited by examiner

*Primary Examiner* — Amy Cohen Johnson
(74) *Attorney, Agent, or Firm* — Michael L. Greenberg, Esq.; Greenberg & Lieberman, LLC

(57) ABSTRACT

A chalk line is marked by attaching two hooks to a nail, and then extending a string a length from the nail. The hooks are attached to an apparatus that has multiple springs, such that there is a string attached to the rear of the apparatus while the hooks are attached to the front of the apparatus. When the string has been extended the desired length, the user then snaps the line to make a chalk line. Then, the pull on the string is released by the user, causing the two hooks to separate. When the two hooks separate, their connection to the nail is broken. The hooks and the apparatus associated with the hooks then is free to be reeled back to the user. The user does not have to return to the nail to remove the hooks and the associated apparatus.

4 Claims, 3 Drawing Sheets

CHALK LINE MARKING SYSTEM

This is a nonprovisional patent application of Provisional patent Application No. 60/990,534 filed on Nov. 27, 2007, and priority is claimed thereto.

FIELD OF THE INVENTION

The present invention is a chalk line marking system for snapping lines. More particularly, the present invention is a system that allows a single worker to snap lines to create straight lines during construction. There is no need for the single worker to return to the point where a line was first attached.

BACKGROUND OF THE INVENTION

Since the early periods in our society, the construction of houses, buildings, and even castles, has been of utmost importance. Not only did people need a dwelling, but the aesthetic qualities of buildings enriched and sometimes characterized different cultures. From the pyramids of Egypt to the Wall in Jerusalem, it is impossible to deny the practical impact construction techniques have had in our lives. As time passed however, the need for modernized construction tactics surpassed the simple practical value they once possessed. Whether it is a house in the Hamptons, or a Ski Lodge in Aspen, people nowadays tend to value themselves and each other according to their possessions—i.e., their homes. Therefore, a need emerged for construction techniques to become more effective and sophisticated for residential and commercial construction.

As architecture grows in influence, different and modernized construction apparatus are developed and are becoming more efficient. Recently, however, a realization emerged that although some techniques have evolved tremendously, others remain primitive. For instance, one of the first steps in the process of constructing anything, is to draw straight lines on a concrete surface in order to make sure walls or windows are not crooked.

Current techniques utilized to make sure the lines are straight have inherent limitations that ultimately, restrict their usefulness. For example, one prevalent technique is called "Snapping a line". In this technique, construction workers utilize a string, attached to a conventional reel in a conventional chalk box to mark lines on a work surface. The steps to this process are: 1) pinning a nail on one end of a desired perimeter (point A); 2) connecting the string around it; 3) walking across the room to the desired location (point B); and 4) "snapping a line". Once the line is snapped, chalk dust present in the string rubs onto the work surface and causes a straight line to be marked. Although this technique has been highly utilized, it has one crucial intrinsic limitation. When the line is marked, the individual working on it has to walk back to the nail (point A), and disconnect the string from the nail, which is extremely time consuming considering the large dimensions of some buildings. Another way this technique can be employed is to have another worker hold onto one end of the string, functioning as the nail would in the previous scenario (point A) while the other walks to the desired spot (point B). Although this option is not as time consuming, it requires two workers to perform this task, which makes it a lot more expensive. These limitations created a need for new, more effective, and less time consuming ways to snap lines, so that it can be done efficiently by only one individual.

SUMMARY OF THE INVENTION

The present invention uses a modified version of the "Snap a line" technique to mark the initial construction line on a work surface. The device functions similarly to a measuring tape. Although it works from the same principle as the old version, the present invention allows the individuals drawing the line to automatically release the line, without having to walk back to the initial nail and physically disconnect it.

In order to allow for the "automatic disconnecting" to happen, the present invention possesses hooks, which are placed around the nail (point A). The individual marking the line walks to the desired spot (point B), draws tension on the string and "snaps the line". The snapping causes a line to be rubbed onto the work surface. Once the line is marked, the individual simply releases tension on the string, which pushes the hooks forward separating them. This process will automatically release the device.

This technique is a lot more effective because it allows the individual working on the lines to do everything by himself, instead of needing another worker to assist him. Moreover it will save the individual marking the line the time that takes to walk back to the original nail (point A), and manually disconnect it.

BRIEF DESCRIPTION OF THE DRAWINGS

The invention will be better understood and objects other than those set forth above will become more apparent when consideration is given to the following detailed description thereof. Such description makes reference to the annexed drawings wherein.

DETAILED DESCRIPTION OF THE INVENTION

Figure 1:
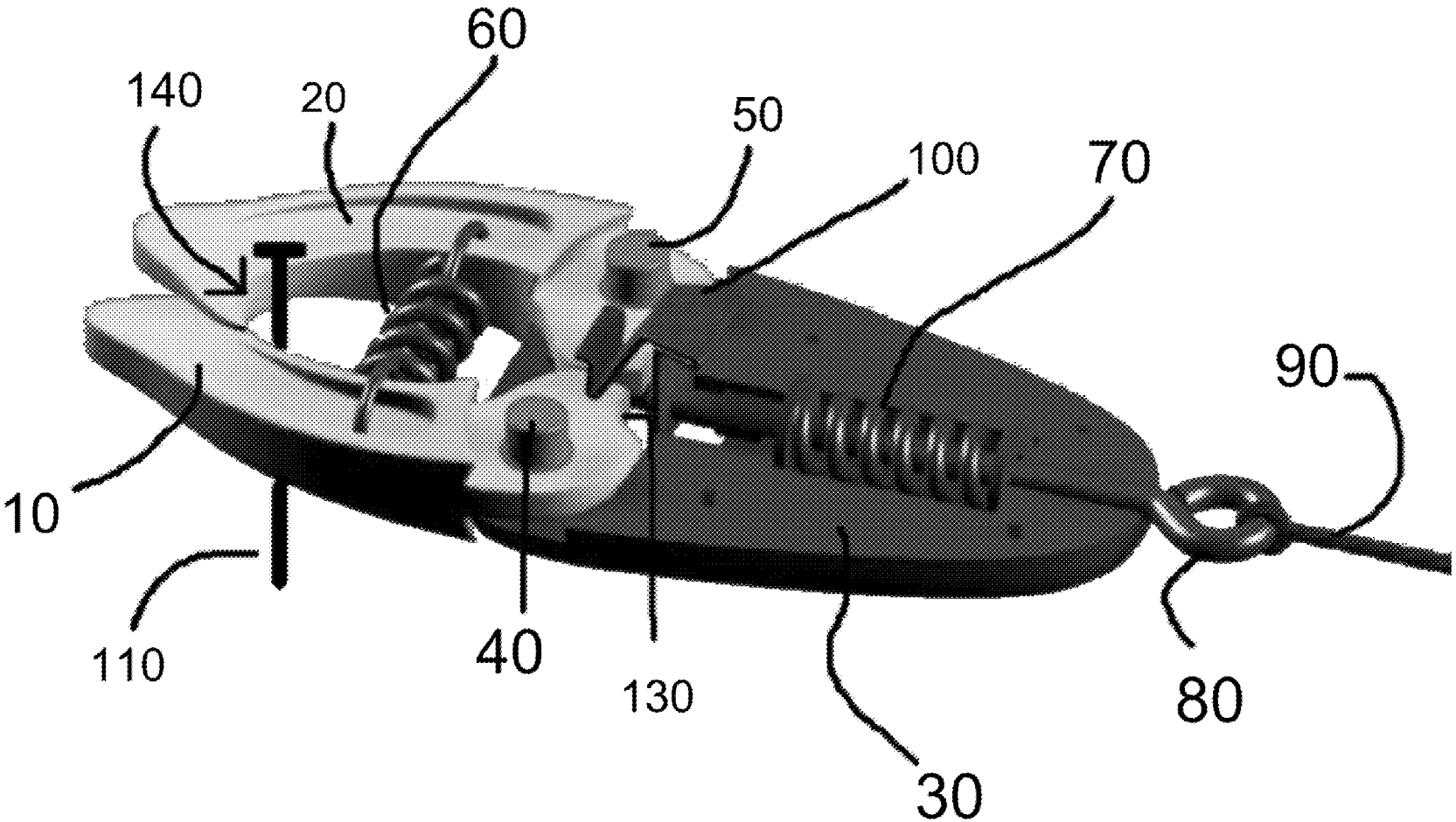
FIG. 1 is an environmental view of the present invention showing a first embodiment of the present invention prior to use.

The present invention will be better understood and objects other than those set forth above will become more apparent when consideration is given to the following detailed description thereof. Such description makes reference to the annexed drawings wherein:

In FIG. 1, we see an environmental view of the present invention. As shown from this view, a curved first hook (10) is connected to the main body (30) by a first post (40). Moreover, a curved second hook (20) is also connected to the main body (30) by a second post (50). The first hook (10) and second hook (20) overlap at the tip making a closed hoop (140). This gives the user the opportunity to place the first and second hooks (10, 20) around a nail (110). The first and second posts (40, 50) allow the first and second hooks (10, 20) to rotate back and forth. Conventionally, a user would use a conventional chalk lining device to snap a line on a work surface. With the present invention, the user also uses a conventional chalk line to snap a line on a work surface. However, with the present invention, once the user has marked a line on a work surface, the user can open the first and second hooks (10, 20) and fully release the present invention from the nail (110), allowing the user to reel in the present invention. In other words, the present invention is used in conjunction with a conventional chalk line reel.

The first and second hooks (10, 20) are held together by a first spring (60), that when in resting position, keeps them overlapped. Alternatively, in another embodiment of the present invention, first spring (60) is replaced with two springs that, when in resting position, push on the base of first and second hooks (10, 20) in order to keep them overlapped. It should also be noted that a conventional torsional spring could replace first spring (60) so that there would be two torsional springs aligned with first and second posts (40, 50)—one torsional spring between first hook (10) and main body (30), and a second torsional spring between second hook (20) and main body (30).

Additionally, a second spring (70) is burrowed in the center of the main body (30) around loop plunger (80). Loop plunger (80) is connected, at a first end, to a malleable tap (100)—malleable tap (100) placed in between the main body (30) and the first and second hooks (10, 20). Loop plunger (80) is connected, at a second end, to string (90). Movement of loop plunger (80) is controlled by second spring (70).

Figure 3:
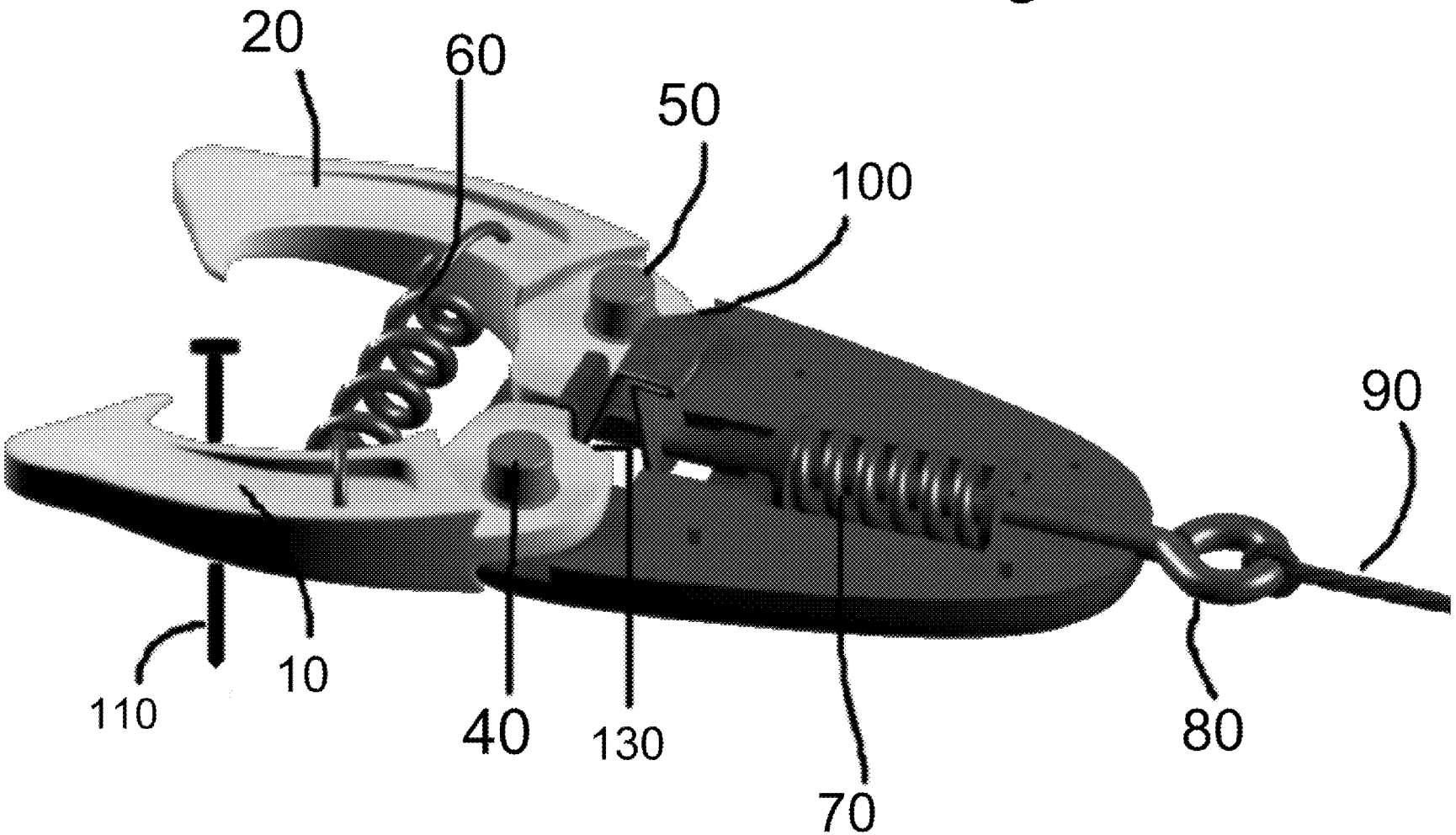
FIG. 3 is an environmental view of the present invention showing the loop returned back within the present invention, the second spring expanded and the tap pushing against the bottom of the hooks, causing the first spring to expand and the hooks to open.

The second spring (70) has greater tensile strength than first spring (60). Its purpose is twofold: it causes loop plunger (80) to hold the tap (100) in place when second spring (70) is in a resting position, and second spring (70) pushes the loop plunger (80) and the tap (100), because the loop plunger is connected to the tap (100), against the rear of first and second hooks (10, 20) when pressure is applied, as shown in FIG. 3, forcing the first spring (60) to expand allowing the first and second hooks (10, 20) to be pushed apart and releasing the nail (110). Moreover, the second spring (70) is connected to the loop plunger (80), positioned at the end of the main body (30). A string (90), is in turn, attached to the loop plunger (80) at one end while the other end is attached to a conventional reel in a conventional chalk box that is conventionally used to "snap a line."

As shown in FIG. 1, once the user places the first and second hooks (10,20) around the nail (110) (point A), he can walk away from the nail (110) (point A) and toward a predetermined point B, holding onto a conventional chalk line device as the string (90) unspools from the conventional chalk line device. As the user walks away from the nail (110) (point A), and toward the predetermined point B, the user will naturally pull string (90); however, second spring (70) has sufficient tensile strength to avoid compression. Thus, string (90) can be unspooled from the conventional chalk line device without causing second spring (70) to compress. Even though second spring (70) has great tensile strength, and prevents the tap (100) from prematurely engaging the hooks (10, 20) under the moderate tension that is put on string (90) during the un-spooling of string (90) from the conventional chalk line device, it should be noted that when great tension is put on string (90) that it is desirable that second spring (70) does compress so as to allow tap (100) to engage hooks (10, 20), as further explained below. When in resting position, the tap (100) is positioned such that the bottom of the tap (100) rests on top of the rear of the first and second hooks (10, 20).

Figure 2:
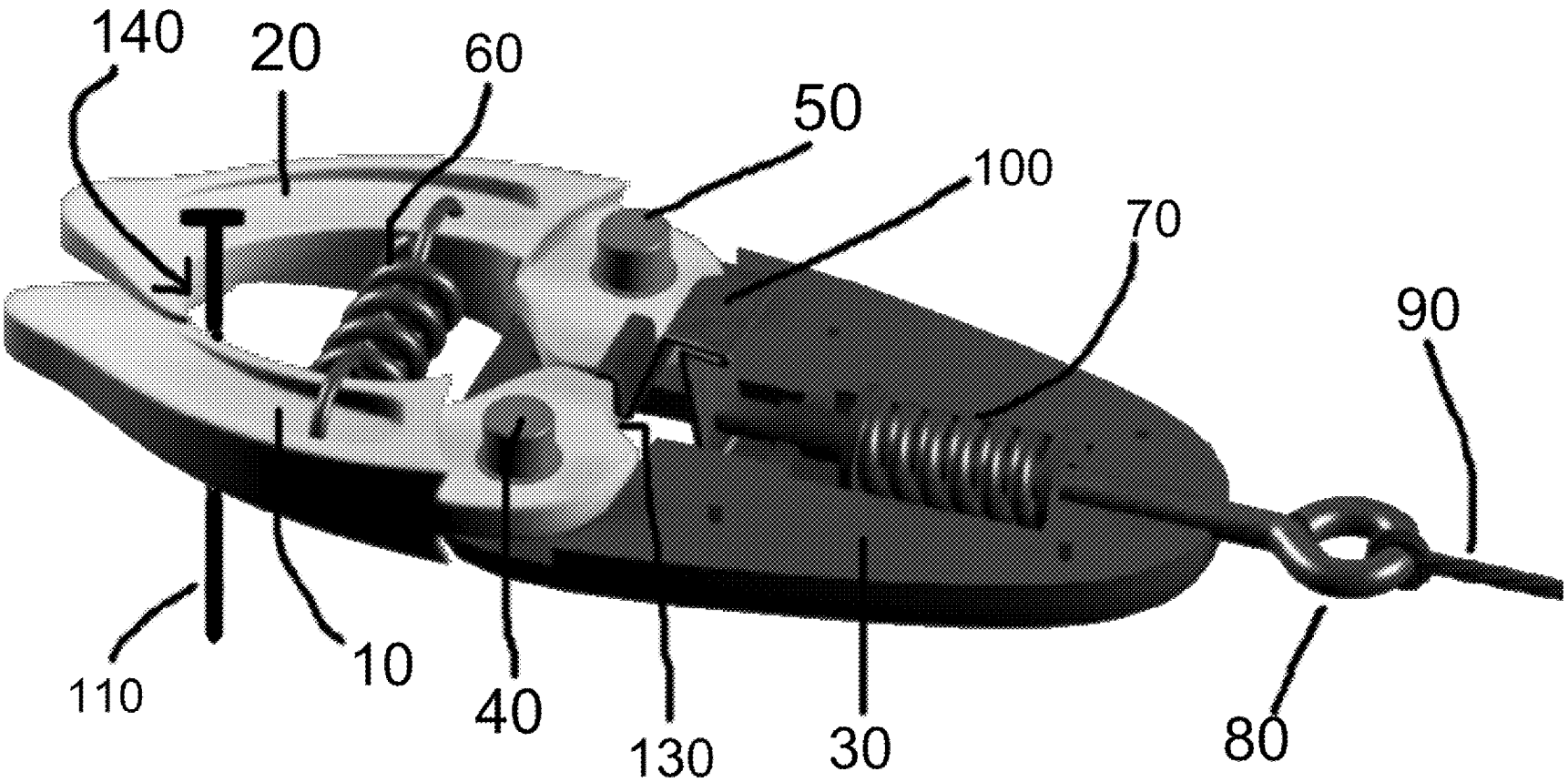
FIG. 2 is an environmental view of the present invention showing the loop extended out of the present invention, the second spring being compressed and the bottom of the tap fitting into a curvature.

In FIG. 2, we see an environmental view of the present invention. In this view, we see the string (90) un-spooled from the reel of the conventional chalk box and being tensioned by the user in preparation for snapping the string (90) to make a chalk line on the work surface.

As the user applies tension to the string (90) in preparation to snap the line by pulling string (90), the second spring (70) is then compressed, and the tap (100) is pulled beyond the rear of the first and second hooks (10, 20), causing the bottom of the tap (100) to fall behind the rear of the first and second hooks (10, 20) and fit into a notch (130) formed behind and at the base of first and second hooks (10, 20).

To snap a line, the user walks to the desired spot (point B), then the user touches the string (90) to the work surface, pulls it up with his free hand, and snaps the string (90) (or "snaps a line"), which marks the work surface with the chalk.

In FIG. 3, we see an environmental view of the present invention. Once the steps of FIG. 2 are completed, the string (90) has been snapped onto the work surface, the line has been marked onto the work surface, and the user then releases the tension from the string (90), causing the second spring (70) to expand back to its original position returning the loop plunger (80) back within main body (30). This expansion pushes the tap (100) forward causing the first and second hooks (10, 20) apart simultaneously. The first post (40) connected to the rear of the first hook (10) and the second post (50) connected to the rear of the second hook (20) will allow for the rotating movement of first and second hooks (10, 20), forcing the first spring (60) to expand allowing the first and second hooks (10, 20) to separate, causing the nail (110) to be swept to the center of the tips of the first and second hooks (10, 20). Because the first and second hooks (10, 20) have separated, the present invention is released from nail (110).

In order for first and second hooks (10, 20) to be able to return to their original position, as shown in FIG. 1, the user must manually return the tap (100) back to it original position as shown in FIG. 1.

I claim:

1. A marking system for construction, comprising:

a main body;

a first hook configured to connect to said main body at a first post;

a second hook configured to connect to said main body at a second post;

said first hook and said second hook configured to overlap into a closed loop at a tip;

said first post and said second post configured to allow said first hook and said second hook to rotate back and forth;

said first hook and said second hook configured to hold together via a first spring such that said first hook and said second hook overlap while in a resting position;

a second spring positioned in the center of said main body around a loop plunger, said loop plunger configured for movement that is controlled by said second spring;

said loop plunger being connected, at a first end, to a malleable tap;

said malleable tap being located between said main body, said first hook and said second hook;

said loop plunger connected, at a second end, to a string;

said second spring having greater tensile strength than said first spring;

said second spring, connected to said loop plunger at an end of said main body, being configured to cause said loop plunger to hold said malleable tap in place;

said second spring configured to push said loop plunger and said malleable tap via connection between said loop plunger and said malleable tap against the rear of said first hook and said second hook when pressure is applied;

said first spring configured to expand when pressure is applied such that said first hook and said second are pushed apart and a nail can be released;

a bottom of said malleable tap configured to fit into a notch at the base of said first hook and said second hook when tension applied to said string causes said second spring to compress;

said second spring configured to expand back to its original position returning said loop plunger back within said main body when tension is released from said string; and said malleable tap configured to push forward such that said first hook and said second hook to come apart simultaneously.

2. The marking system for construction of claim 1, wherein said string is configured with greater tensile strength than said second spring.

3. The marking system for construction of claim 1, wherein said first hook and said second hook connect to said main body at a same end of said main body.

4. The marking system for construction of claim 1, wherein said first hook and said second hook are curved.

* * * * *